US005768729A

United States Patent [19]

Cracraft

[11] Patent Number: 5,768,729

[45] Date of Patent: Jun. 23, 1998

[54] ADAPTIVE FILL CONTROL FOR AN AUTOMATIC WASHER

[75] Inventor: Mark A. Cracraft, Urbandale, Iowa

[73] Assignee: Maytag Corporation, Newton, Iowa

[21] Appl. No.: 770,940

[22] Filed: Dec. 19, 1996

[51] Int. Cl.[6] ..... D06F 33/02

[52] U.S. Cl. ..... 8/158; 68/12.05; 68/12.21; 68/207

[58] Field of Search ..... 8/158; 68/12.05, 68/12.21, 207

[56] References Cited

U.S. PATENT DOCUMENTS

| | | | |
|---|---|---|---|
| 4,303,406 | 12/1981 | Ross | 8/158 |
| 4,503,575 | 3/1985 | Knoop et al. | 8/158 |
| 4,835,991 | 6/1989 | Knoop et al. | 68/207 X |
| 5,144,819 | 9/1992 | Hiyama et al. | 68/12.05 X |
| 5,285,545 | 2/1994 | Payne et al. | 8/158 |

FOREIGN PATENT DOCUMENTS

| | | | |
|---|---|---|---|
| 164594 | 7/1986 | Japan | 68/12.05 |
| 8794 | 1/1987 | Japan | 68/12.05 |

*Primary Examiner*—Philip R. Coe
*Attorney, Agent, or Firm*—Zarley, McKee, Thomte, Voorhees, & Sease

[57] ABSTRACT

A method and apparatus of adaptively filling a washing machine uses a water level signal from an analog pressure sensor to determine the appropriate fill level of the machine. A fuzzy logic knowledge base uses various inputs which are scaled and added together to create an output value. The inputs to the fuzzy logic knowledge base include the current pre-defined level, the Ross input, the last rate difference value, and the peak rate level. The present invention may also be used to determine the fabric type of the clothing in the washing machine.

28 Claims, 7 Drawing Sheets

ADAPTIVE FILL CONTROL FOR AN AUTOMATIC WASHER

BACKGROUND OF THE INVENTION

1. Field of the Invention

The present invention relates to automatic washing machines. More particularly, though not exclusively, the present invention relates to a method and apparatus for automatically filling the washer to the proper water level.

2. Problems in the Art

A typical prior art washing machine will have a number of user selectable water levels which the user manually selects depending on the size of the load of clothes to be placed in the washing machine. For example, if the user loads just a few articles of clothing into the washing machine, the user may select "Extra Small" on the control panel which causes the washing machine to fill to a predetermined level corresponding to "extra small". Similarly, if the user loads a lot of articles of clothing into the washing machine, the user may select "Large" on the control panel which causes the washing machine to fill to a predetermined level corresponding to "Large".

Manually selected water levels have various disadvantages. First, having to select the appropriate water level when starting each load of clothes is inconvenient and time consuming to the user. As a result, a user may select a larger cycle than necessary in order to ensure that enough water is loaded to wash the clothes. This results in an inefficient use of water and also increases the wash time. It can therefore be seen that a washing machine having an automatically selected water level would be desirable.

There have been attempts in the prior art to provide automatic water level controls. Some prior art attempts involve spraying a certain amount of water into a spinning load of fabrics and collecting a portion of the liquid as a measure of the liquid absorbed by the load. Other prior art systems sense the agitation torque of the agitator to indicate the proper liquid level. Other systems sense the number of fabric roll overs per unit of time in the washing liquid. Yet another system uses the movement of the wash tub during the agitation stage to determine the proper water level in the washer. All of these prior art systems have disadvantages including reliability, accuracy, etc.

One prior art automatic liquid level control is disclosed in U.S. Pat. No. 4,303,406 issued to Ross on Dec. 1, 1981 and assigned to the assignee of the present invention. The Ross patent discloses an apparatus for measuring the rate of change of liquid level in the tub in the presence of the fabrics as a gauge of the total liquid required to treat the specific load in the basket. However, it is desirable to provide a system that is more accurate and reliable than the system disclosed in the Ross patent.

OBJECTS OF THE INVENTION

A general object of the present invention is the provision of an adaptive fill control for a washing machine that overcomes problems found in the prior art.

A further object of the present invention is the provision of an adaptive fill control for a washing machine which uses a plurality of inputs to determine the proper level of liquid in the washing machine.

A further object of the present invention is the provision of an adaptive fill control for a washing machine which uses fuzzy logic to determine the proper liquid level in the washing machine.

A further object of the present invention is the provision of an adaptive fill control for a washing machine which uses information from an analog pressure sensor to determine the proper liquid level in the washing machine.

A further object of the present invention is the provision of an adaptive fill control for a washing machine which is more reliable and efficient than systems found in the prior art.

These as well as other objects of the present invention will become apparent from the following specification and claims.

SUMMARY OF THE INVENTION

The method and apparatus of the present invention is used to automatically fill a washing machine to the appropriate level. During a fill cycle, the water level in the washing machine is sensed over time. A number of values can be determined from the sensed water level over time. A proper fill level is determined from these various values. When the water level reaches the proper level, the water flow is stopped.

The method of the present invention may use a fuzzy logic algorithm to determine the proper fill level. Inputs to the fuzzy logic algorithm may include the current water level, an input indicative of the size of the load, the difference in fill rate at different times, and the level at which the rate of increase in water level stops increasing. The present invention may optionally determine the fabric type of the clothing in the washing machine by monitoring various characteristics of the water level over time. The observed characteristics can be compared to known characteristics for various fabric types.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
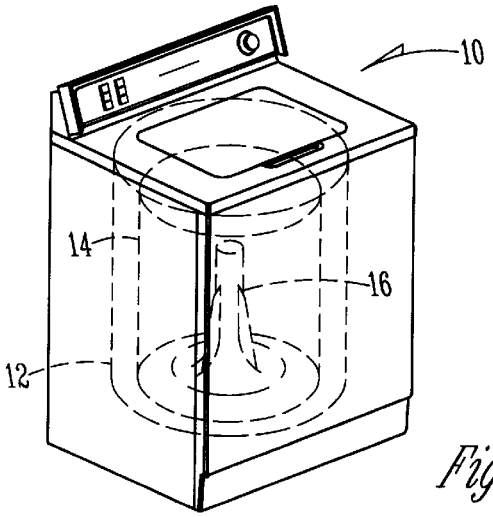
FIG. 1 is an isometric view of a washing machine of the present invention.

The preferred embodiment of the present invention relates to a washing machine 10 as shown in FIG. 1. The washing machine 10 has a wash tub 12 for holding water (shown with dashed lines). Within the wash tub 12 is a perforated basket 14 which holds the clothing to be washed. An agitator 16 is located within the basket 14 for agitating the clothing during agitation cycles. The washing machine 10 of the present invention is capable of automatically selecting the proper water level for various clothing loads. The washing machine 10 utilizes an analog pressure sensor 18 with readings taken directly from the air dome of the mechanical pressure switch 20. The pressure readings correspond directly to the change in water level in the wash tub 12. Using a fuzzy logic knowledge base, the change in water level and its derivatives are evaluated and the appropriate fill level is selected. Various inputs to the fuzzy logic knowledge base are used and include: the current water level, an input indicative of the size of the load, the difference in fill rate at different times, and the level at which the rate of increase in water level stops increasing.

The system and method for providing an adaptive fill for the washing machine 10 uses data from an analog pressure sensor 18 as well as derivatives from signals from the analog pressure sensor 18. Due to the variability and randomness of various laundry loads in an automatic washing machine, such as washing machine 10, a discrete method for the determination of the laundry load size becomes complicated. The present invention utilizes characteristic fill patterns which are identified by monitoring the level of the water in the wash tub 12 during the fill process. These characteristics provide information about a particular load of clothing. Among other things, this information contains clues as to when the load of clothing is covered by water in the wash tub 12 of the washing machine 10. This has been determined by recognizing a known change in water level for a given increment in time or recognizing a known level increase for a given amount of water introduced to the wash tub 12 measured by volumetric counters or flow sensors.

The present invention is capable of observing when the load of clothes has been covered with water in the wash tub 12 without the need of constants related to flow rates or known measurements of water flow rates from water flow sensors, etc. This eliminates the requirement of knowing the incoming water flow rate or assuming the incoming flow rate. If the incoming flow rate is assumed, variations in water pressure will cause variations in the flow rate and therefore inconsistencies with the result. The cost of adding a flow sensor to sense the incoming water flow rate is cost prohibitive.

The present invention overcomes these problems by analyzing over time the signal which represents the fill level. This analysis provides several unique attributes about the load of clothes in the wash tub 12. Of these unique attributes, the rate of change of the water level is important with respect to determining when the load of clothes is covered with water. As the filling process proceeds, water is introduced into the wash tub 12 and is initially absorbed by the clothing in the wash tub 12. The water level in the wash tub 12 rises slowly while being absorbed by the clothing. As the clothing becomes saturated with water, the water level in the wash tub 12 increases faster than when empty due to the displacement of water by the load of clothes. As the water reaches a level which either covers the load of clothes or allows the clothes to float, the load displacement does not effect further water level increases. At this time, the water level increases at a constant rate since the load is either covered with water or is floating on top of the water.

In this way, the present invention can use a single analog pressure sensor and does not require any knowledge of the water pressure, the water flow rate, or the volume of water in the wash tub 12. This is discussed in detail below.

Figure 2:
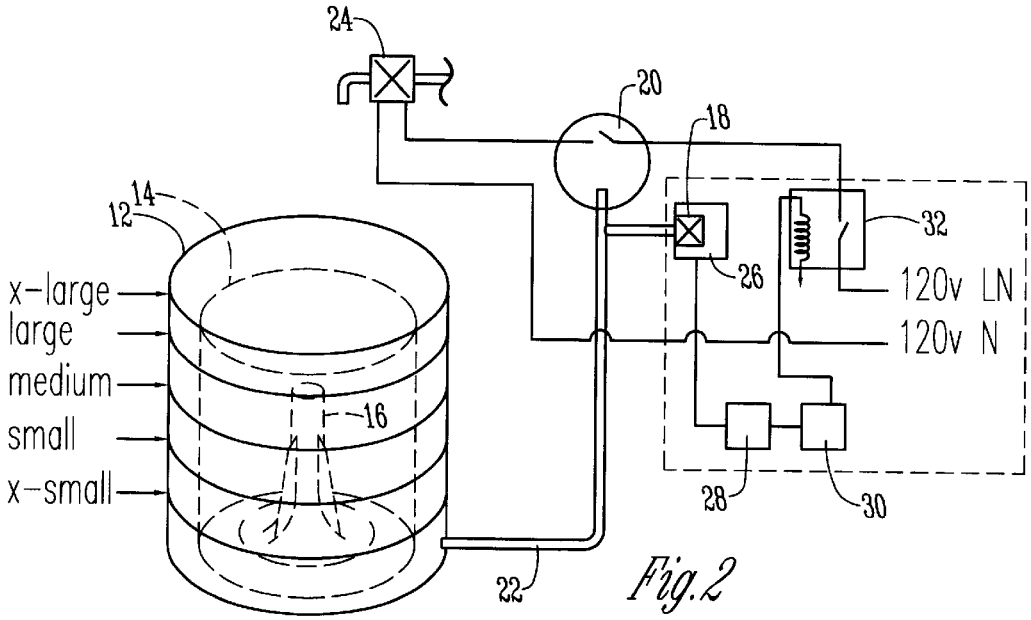
FIG. 2 is a diagram showing an analog pressure sensor and related components for sensing various water levels in a wash tub.
Figure 3:
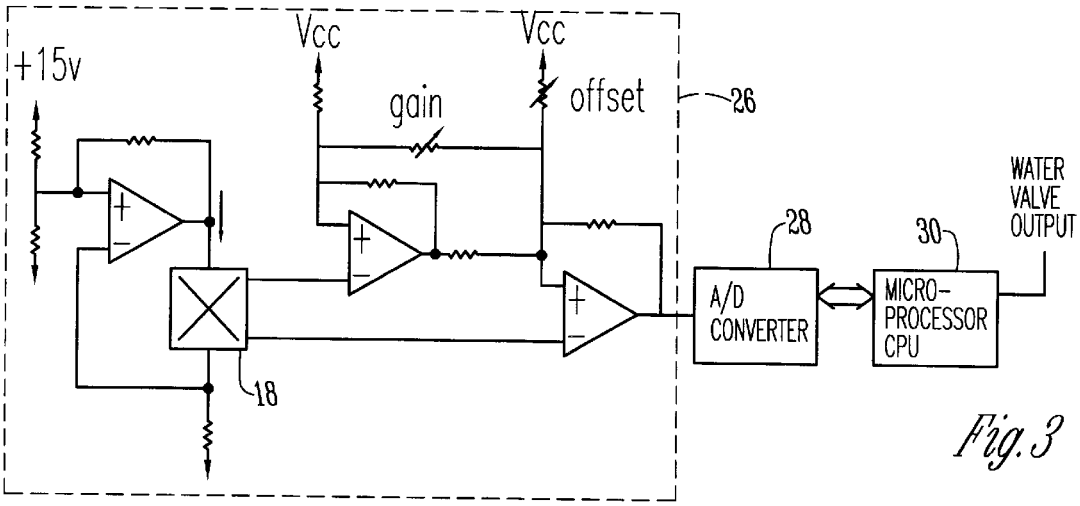
FIG. 3 is an electrical schematic diagram of the pressure sensor and microprocessor circuit shown in FIG. 2.

The present invention uses a silicon based multi-position liquid pressure sensor to sense the water level in the wash tub 12 over time. FIG. 2 shows the wash tub 12 and a schematic diagram of the water pressure sensor. The multi-level or infinite level pressure switch is derived from the use of a silicon pressure sensor 18 and a low cost single level mechanical pressure switch 20. As shown in FIG. 2, the pressure sensor 18 and pressure switch 20 are connected to the air dome hose 22 which is in communication with the wash tub 12. As the level of water in the wash tub 12 rises, the air pressure in the air dome (not shown) via the air dome hose 22 will rise. The use of the air dome hose 22 with the air dome is conventional. The mechanical pressure switch 20 is electrically connected to the inlet water valve 24 which is used to fill the wash tub 12 with water. The mechanical pressure switch 20 is used to protect against overflows of the wash tub 12 by switching off the water valve 24 when the water reaches the extra-large fill level. The pressure sensor 18 includes a related silicon pressure sensor circuit 26. The sensor circuit 26 is connected to an A/D converter 28 and a microprocessor CPU 30. The output of microprocessor 30 is connected to a water valve relay 32 which controls the water valve 24. In this way, the microprocessor 30 can control the activation of the water valve 24 and thus control the water entering the wash tub 12. FIG. 3 is an electrical schematic diagram showing the pressure sensor 18, the pressure sensor circuit 26, the A/D converter 28, and the microprocessor 30 shown in FIG. 2.

The microprocessor 30 uses the voltage at the water valve 24 to determine when the extra-large level has been reached. When the extra-large level is reached, the microprocessor 30 records the corresponding voltage provided by the silicon pressure sensor circuit 26. This operation could be done on the first fill after a power interruption or during a factory functional test which would require storing the value in a non-volatile memory. If the silicon pressure sensor circuit 26 is calibrated in the factory by the electronics manufacturer to provide a known gain (volts per inches of water) and the extra-large water level has been recorded, any other water level can be determined to the resolution of the sensor used. For example, if an 8 bit value is used by the microprocessor 30, this would allow 255 ($2^8$) discrete water levels to be provided between the lowest sensed level and the extra-large level. For a typical wash tub 12 being 18 inches deep, this results in a theoretical accuracy of 7/100th of an inch in water level, although circuit noise, ambient noise (water splashing), and circuit non-linearity will limit this resolution.

To determine the sensor output for a water level at "X" inches below the extra-large level, the following relationship is used:

Level at "X" inches below 'Extra-Large'= (Voltage@Extra-Large)–(gain of sensor)*("X" inches).

During any subsequent fills, the microprocessor 30 calculates what level the water is at in the wash tub 12 from the voltage provided by the silicon pressure sensor circuit 26. The microprocessor 30 may select to stop filling or continue filling based upon a user selected input or an intelligent fill algorithm (described below).

An optional approach can be used to reduce the factory calibration requirements of the sensor circuit 26. Under this optional approach, the sensor output at the point when the sensor level begins changing (when the water fills enough to seal the air dome cavity) would be recorded. Using this known level and the extra-large level, the gain of the pressure sensor 18 can be determined. The circuit would need to be designed to ensure that the gain of the pressure sensor 18 is not large enough to exceed the maximum input voltage level of the A/D converter 28 at the extra-large level and to ensure that the pressure sensor 18 null offset voltage is not negative.

These same water level measurements taken during filling of the wash tub 12 can be used in correspondence with the elapsed time to calculate an estimated water flow rate. The change in water level used with the elapsed time between level measurements and known cross-sectional area of the wash tub 12 can be used to calculate the water flow rate (in gallons/minute) using the following relationship:

$$\text{Flow Rate} = \frac{(\text{Volts@Lev. 2} - \text{Volts@Lev. 1}) * A * (60 \text{ seconds/min.})}{G * t * (231 \text{ cubic in./Gal.})}$$

Where:

Lev. 1=a first sampled level

Lev. 2=a second sampled level

A=Cross sectional area of the tub (in.$^2$)

G=Gain of the sensor (volts/inch)

t=elapsed time (seconds)

The present invention uses an output signal from the analog pressure sensor 18 as well as derivatives of that signal as inputs into a fuzzy logic engine. Again, due to the variability and randomness of laundry loads in a washing machine, a discrete method for the determination of load size becomes complicated. Characteristic fill patterns which are observed by monitoring the level of the water in the wash tub during the fill process provide information about the particular load.

The key element in the adaptive fill algorithm is the rate of change of the water level versus time. Ideally, the water level would be monitored by analog pressure sensors and calibrated by water flow sensors. Since the use of water flow sensors is cost prohibitive, another technique is desirable.

The present invention analyzes a signal representing the fill level over time which provides several unique attributes or characteristics about the load in the wash tub 12. These unique attributes relate to the first and second derivatives of the original fill level signal from the analog pressure sensor. The signal characteristics include the absolute magnitude of the first derivative, the time of the peak value of the second derivative, the peak magnitude of the second derivative, etc. These signal characteristics and others are used as inputs to a fuzzy logic knowledge base used to determine the load size in the wash tub 12. The fuzzy logic knowledge base generates an output which represents the degree of confidence to stop or not stop filling.

The adaptive fill algorithm used with the present invention combines fuzzy logic and traditional logic techniques. The adaptive fill algorithm involves many derived values from the sampled pressure sensor output discussed above. The algorithm is processed periodically throughout the fill process. Preferably, every 100 milliseconds, a pressure sensor value is retrieved and filtered to remove high frequency noise components. The sample is then processed to calculate values which are provided as inputs to the fuzzy logic knowledge base and the final decision matrix.

The fuzzy logic algorithm uses four inputs which are scaled and added together to create an output value. These inputs include: (1) the current level, (2) an input indicative of the size of the load (the Ross input), (3) the difference in fill rate at different times (the last rate difference), and (4) the level at which the rate of increase in water level stops increasing (the peak rate level). All of these inputs are described in detail below.

Figure 4:
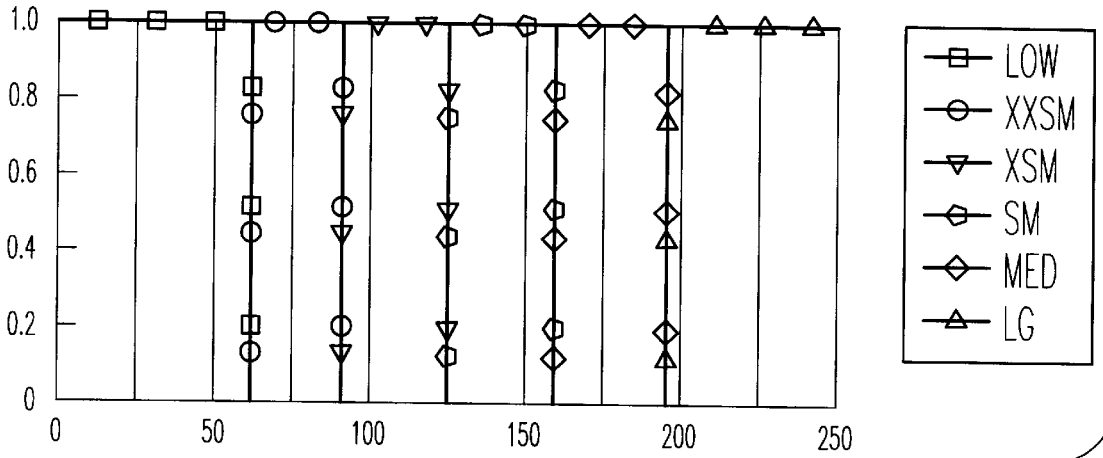
FIGS. 4–8 show the fuzzy logic input and output membership functions.

The first input to the fuzzy logic algorithm is the current level. The pre-defined levels are water levels in the wash tub 12 which are pre-defined and correspond to low, extra-small, small, medium, large, etc. The pre-defined water levels are illustrated by arrows in FIG. 2. During filling, the output value of pressure sensor 18 is filtered and processed to determine when a pre-defined level has been reached. FIG. 4 is a diagram showing the membership function of the current level used by the fuzzy logic knowledge base. The algorithm is designed to derive a value in the range of 0 to 255 which relates to 255 increments of water level within the wash tub. As shown in FIG. 4, the horizontal axis ranges from 0 to 255 while the vertical axis represents certainty and ranges from 0 to 1.0 where 0 indicates a certainty of 0% and 1.0 indicates a certainty of 100%. As shown in the legend, the chart indicates the certainties that the current level represents a range of low, xx-small, x-small, small, medium, or large at any given value from the pressure sensor 18. A value of 245 might equal the value at which the mechanical pressure switch 20 trips, which will relate to the extra-large level. As shown in FIG. 4, when the pre-defined level value ranges from about 0–50, there is a 100% certainty that the current predefined level is low and a 0% certainty that the current predefined level is anything else. As can be seen from FIG. 4, as the water level reaches the threshold of each predefined level, the certainty for that level is 100% while the certainty for the remaining levels is 0%. The current predefined level input is important to the fuzzy logic algorithm because certain load characteristics are repetitive throughout a fill cycle. It is the correlation of these characteristics at a specific water level range (the predefined levels, for example) that makes them important.

The second input to the fuzzy logic algorithm is generated by processing a value which is indicative of the load characteristics. The processing of the second input to the fuzzy logic algorithm is a variation of the algorithm used in U.S. Pat. No. 4,303,406 issued to Ross and assigned to the assignee of the present invention. This input will be called the "Ross input" for the purposes of this description. The Ross algorithm is described in detail in the patent mentioned above. The Ross input value is generated by observing the time required to fill the wash tub 12 to a one gallon water level and the time required to fill the wash tub 12 to an eight gallon water level. The time required to fill to the eight gallon level is used to calculate an expected time to fill the wash tub 12 to a one gallon level. A scaled value is then generated from the difference between the actual and expected time to fill the wash tub 12 to a one gallon level. The larger this difference is, the larger the load is anticipated to be. In other words, a large Ross input is indicative of a large load and the fuzzy logic algorithm uses that information in making a decision on whether to continue filling the wash tub 12.

Figure 5:
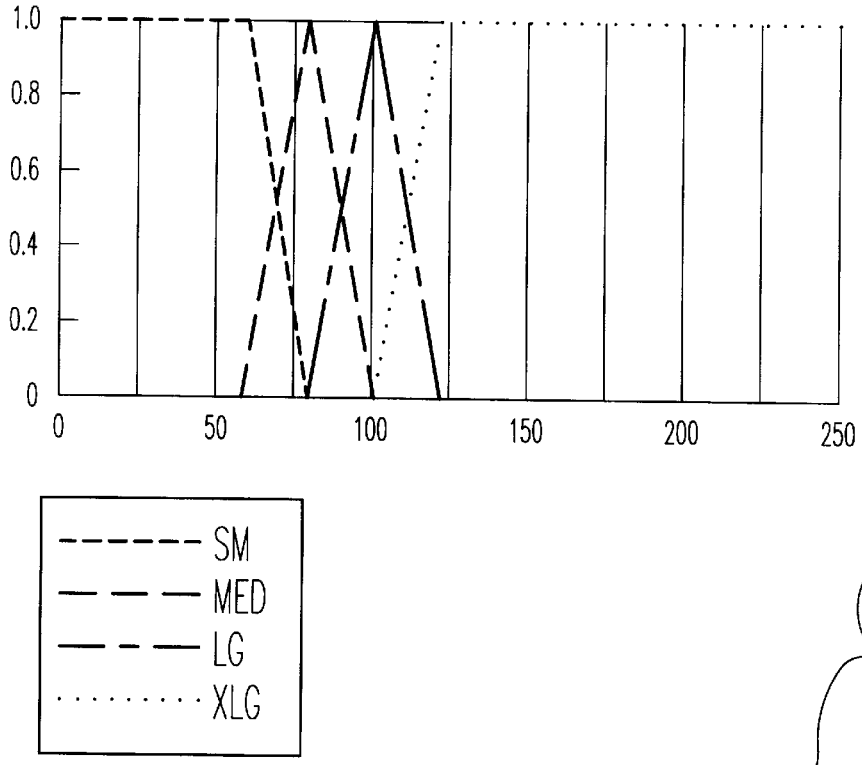

FIG. 5 is a diagram showing the membership function of the Ross level used by the fuzzy logic knowledge base. Again, the Ross value provides information related to the size of the load. The Ross algorithm is designed to generate an output value in the range of 0 to 255. As shown in FIG. 5, the horizontal axis ranges from 0 to 255 while the vertical axis represents certainty and ranges from 0 to 1.0 where 0 indicates a certainty of 0% and 1.0 indicates a certainty of 100%. As shown in the legend, the chart indicates the certainties that the load is small, medium, large, or extra-large. For example, when the Ross value is in the range of about 0 to 50, there is a 100% certainty that the load is small and a 0% certainty that the load is medium, large, or extra-large. When the Ross value is approximately 125 and above, there is a 100% certainty that the load is extra-large and a 0% certainty that the load is small, medium, or large. For the ranges between 50 and 125, FIG. 5 shows the certainties at each value as well. For example, at a Ross value of 75, there is about an 80% certainty that the load is medium and a 20% certainty that the load is small. As shown, there is 0% certainty that the load is large or extra-large.

When the water level reaches each of the pre-defined levels discussed above, the first derivative of the water level signal is recorded. The first derivative of the water level signal is indicative of the rate of change of the water level. When the next pre-defined level is reached, the difference between the current and previous derivatives is recorded and utilized by the fuzzy logic knowledge base as the "last rate difference." Also, throughout the filling process, a dynamic rate difference is recorded by taking the current rate and subtracting the stored rate from the previous pre-defined level.

The pressure difference is calculated from the previous pressure sample and current pressure sample. This difference is passed to a routine which calculates a filtered and scaled value for the first derivative of the pressure reading over time, along with a second derivative of the pressure reading. The first derivative or the rate of change of pressure is then adjusted to correspond to an incoming flow rate of 4 gallons per minute.

Figure 6:
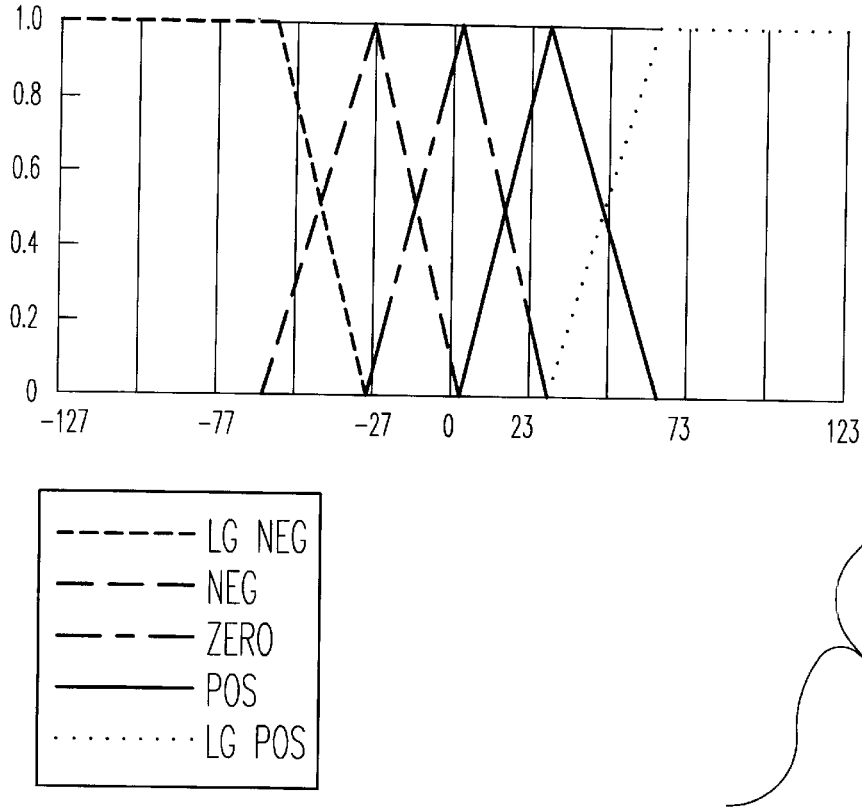

FIG. 6 is a diagram showing the membership function of the "last rate difference" input to the fuzzy logic knowledge base. Again, the last rate difference represents the change in the rate of filling between the current pre-defined water level and the previous pre-defined water level. In other words, if the rate of filling is known at the extra-small level, then between the extra-small and small pre-defined level, the current filling rate is compared to what was observed at the extra-small level. If it is seen during this portion of filling (extra-small to small) that the rate of filling has changed significantly , this signals that the system (wash tub, clothes, water) has not reached equilibrium, therefore filling should continue. It is expected that the rate of filling should become constant once the water has been filled to a level above the clothes, which is the point that filling should end. As shown in FIG. 6, the horizontal axis is centered about 0 and ranges from −127 to 123. As shown in the legend, the lines on the chart represent a large negative, negative, zero, positive, and large positive. When the value of the last rate difference is approximately −77 and below, there is a 100% certainty that the last rate difference is a large negative and a 0% certainty that the last rate difference is negative, zero, positive, or large positive. At approximately 73 and above, there is a 100% certainty that the last rate difference is a large positive and a 0% certainty that the last rate difference is large negative, negative, zero, or positive. Within these ranges, the certainties are shown by the lines as indicated. For example, at 23, there is a certainty of approximately 70% that the last rate difference is positive and a certainty of approximately 30% that it is zero.

The fourth input to the fuzzy logic algorithm is the "peak rate". The value of the peak rate is found by determining the point at which time the second derivative of the pressure samples becomes negative. Note that the first derivative of the pressure samples indicates the rate at which the water level in the wash tub 12 is increasing. The second derivative indicates the rate of change of the rate that the water in the wash tub 12 increases. The second derivative relates physically to the point at which the rate of the water level rising in the tub stops increasing. This value corresponds to the point of filling at which time the water level has surpassed a level at which the largest cross-sectional displacement of clothes is observed.

Figure 7:
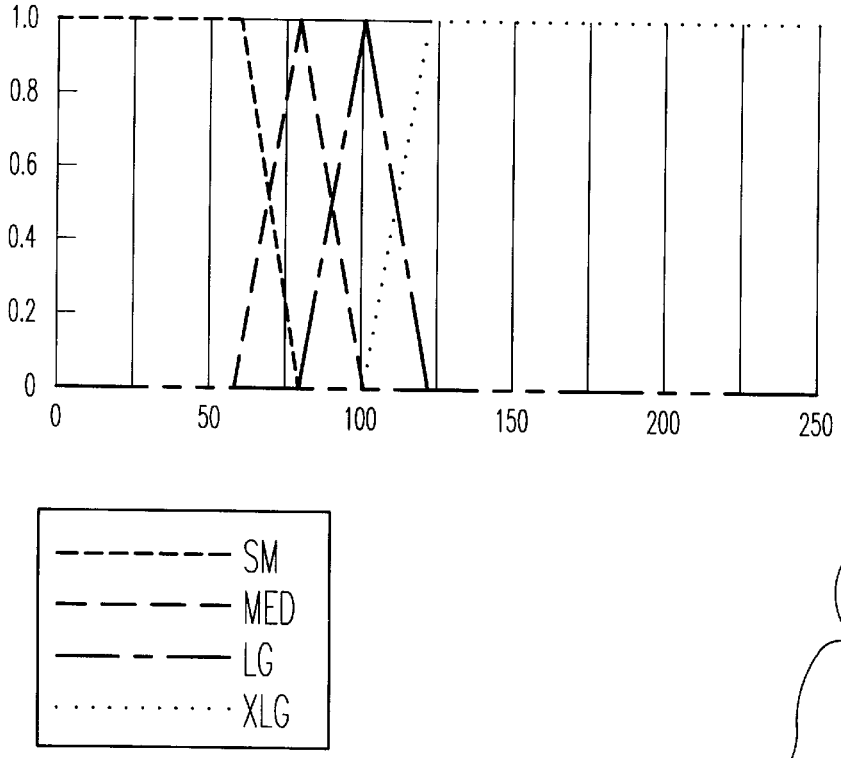

FIG. 7 is a diagram showing the membership function of the peak rate level input to the fuzzy logic knowledge base. Again, the peak rate level represents the point at which the rate of filling stops increasing. As shown in FIG. 7, the horizontal axis ranges from 0 to 255. When the peak rate level value is 50 and below, there is 100% certainty that the load is small and a 0% certainty that the load is any other size. When the value is 125 and above, there is a 100% certainty that the load is extra-large and a 0% certainty that the load is any other size. Between 50 and 125, the certainties of each size of load are shown in FIG. 7. For example, at 75, there is approximately a 70% certainty that the load is medium and a 30% certainty that the load is small.

Preferably, once every second the fuzzy logic knowledge base is applied with the four values described above. Again, the first input to the fuzzy logic knowledge base is the current level. The second input is the result from the Ross algorithm calculation. The third is a value of the last rate difference value calculation. The fourth input is the value of the peak rate level. The output of the fuzzy logic knowledge base is filtered with the value of the previous fuzzy logic output to be used in a decision matrix as to whether or not filling should continue. The output value specifies the degree of confidence that is assigned to the decision whether or not to stop filling. The output value is in the range of 0 to 255, where 0 is a 100% confidence that filling should continue and 255 is a 100% confidence that filling should stop.

Figure 8:
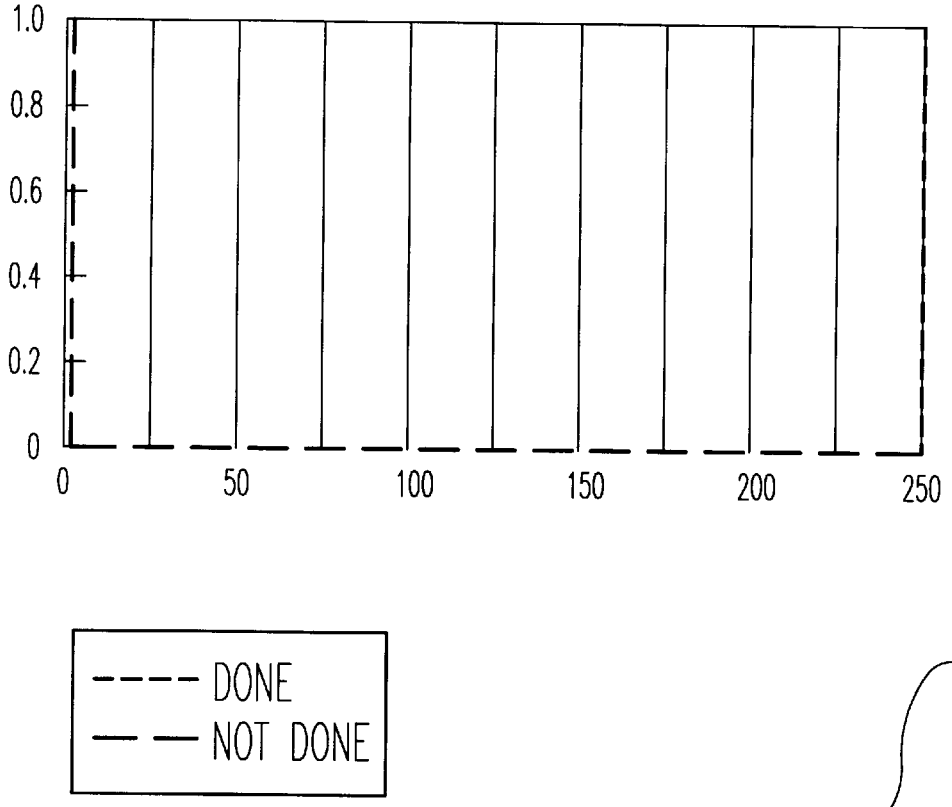

FIG. 8 is a diagram showing the output membership function of the fuzzy logic algorithm. Only two output values are possible for the fuzzy logic rule base, DONE or NOT DONE. The rules of the knowledge base evaluate all of the input criteria and make recommendations to the fuzzy logic output in regard to whether or not the filling is complete. The fuzzy logic will take into account all of the rules which have made recommendations and will perform a weighted averaging of the inputs. An example of rules which could be used with the present invention are listed at the end of this description. Of course many variations of these rules could be used within the scope of the present invention. The final output of the fuzzy logic knowledge base is a value between 0 and 255. A value of 255 represents that from the inputs at that current point in time, there is a 100% confidence that the filling is complete. A value of 1 represents a 100% confidence that the filling is not complete. A value of 128 represents that there is a 50% confidence that the filling is complete and a 50% confidence that the filling is not complete.

Figure 9:
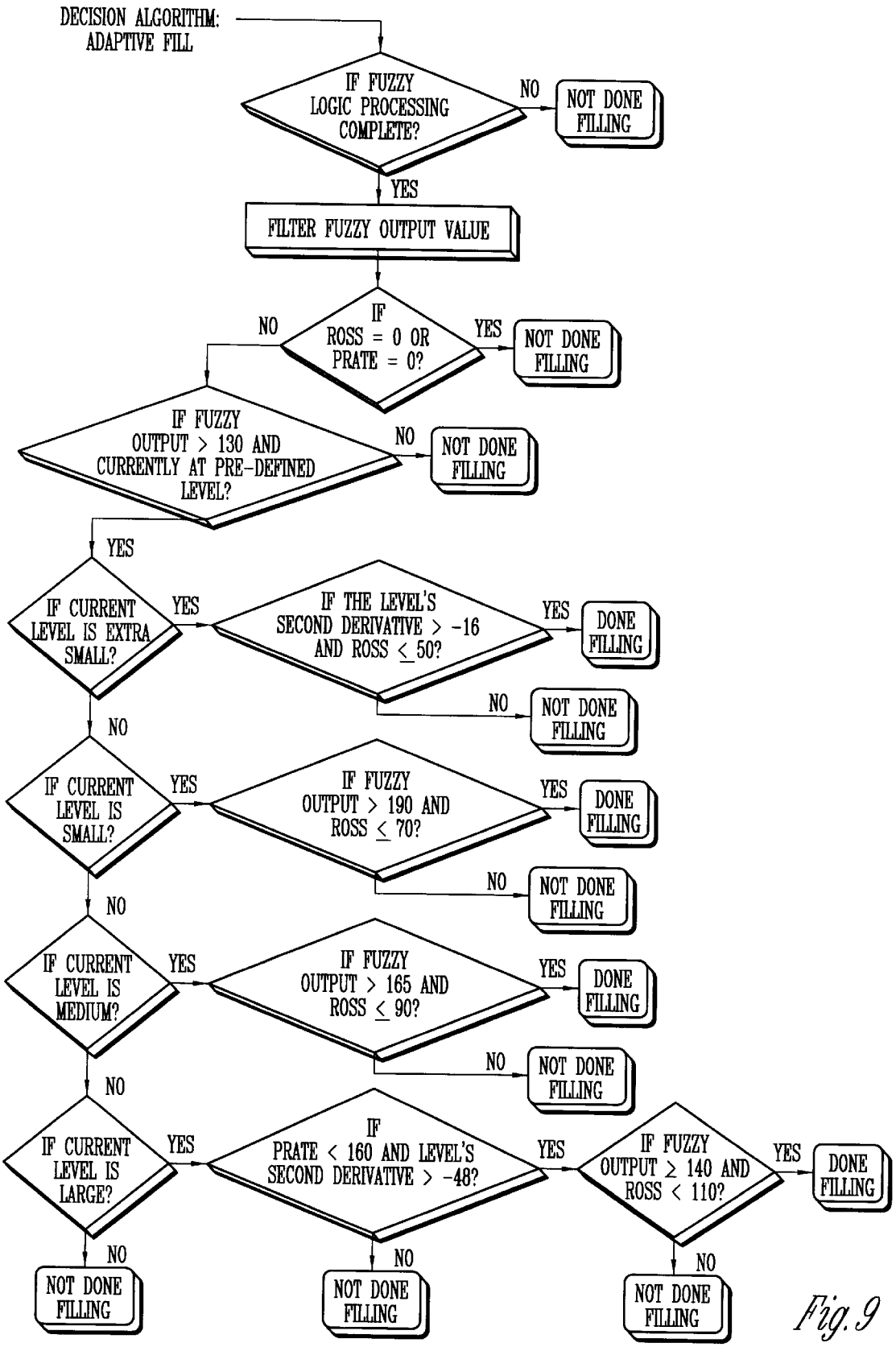
FIG. 9 is a flow chart showing the operation of the present invention.

The final decision to stop filling the wash tub 12 is based on the process illustrated by the flow chart shown in FIG. 9. As shown in FIG. 9, the decision algorithm first asks if the fuzzy logic processing is complete. If so, the fuzzy logic output value is filtered. At this point, if the Ross value equals zero or the peak rate value equals zero, then filling is not complete. If not, and if the fuzzy logic output value is greater than 130 and the level is at a predefined level (extra-small, small, medium, large, extra-large), the filling may be complete. If so, the algorithm then asks if the current pre-defined level is extra small. If so, and if the level's second derivative is greater than 16 and the Ross value is less than or equal to 50, then filling is complete and corresponds to an extra-small load. If the current pre-defined level is not extra-small, then the algorithm asks if the current pre-defined level is small. If so, and if the fuzzy logic output is greater than 190 and the Ross value is less than or equal to 70, then filling is complete and the level corresponds to a small load. If the current pre-defined level is not small, then the algorithm asks if the current pre-defined level is medium. If so, and if the fuzzy logic output is greater than 165 and the Ross value is less than or equal to 90 then filling is complete and corresponds to a medium load. If the current pre-defined level is not medium, then the algorithm asks if the current pre-defined level is large. If not, filling is not complete. If the current pre-defined level is large then the algorithm asks if the peak rate is less than 160 and the level's second derivative is greater than negative 48. If not, filling is not complete. If so, and if the fuzzy logic output is greater than or equal to 140 and the Ross value is less than 110, then filling is complete and corresponds to a large load. If not, filling is not complete.

In an alternative embodiment of the present invention, the type of fabric in the washing machine 10 can be determined during the filling of the washing machine 10. The method of determining the type of fabric characteristic of a load of clothes within the wash tub 12 uses an analysis of the fill level signal over time. The signal is analyzed to determine the load characteristics by observing various aspects of the fill level signal. These aspects of the signal can be used to help determine the load size and the type of load in the wash tub 12. This in turn can be used to determine the amount of water to be used during the wash cycle, the temperature of the water to be used during the wash cycle, and the wash cycle that should be selected, etc. The fabric type could also be used in the fuzzy logic knowledge base discussed above to help determine the appropriate water fill level.

Different types of clothes have different fill characteristics such as water absorbency and water displacement. These characteristics can be observed by inspecting the rate of change of the fill level (the first derivative of the level signal) and also the rate of change of the fill level rate (the second derivative of the level signal). Again, the rate of change of water level during a fill corresponds to the first derivative of the level signal while the second derivative of the level signal corresponds to the rate of change of the fill level rate of change.

Figure 10:
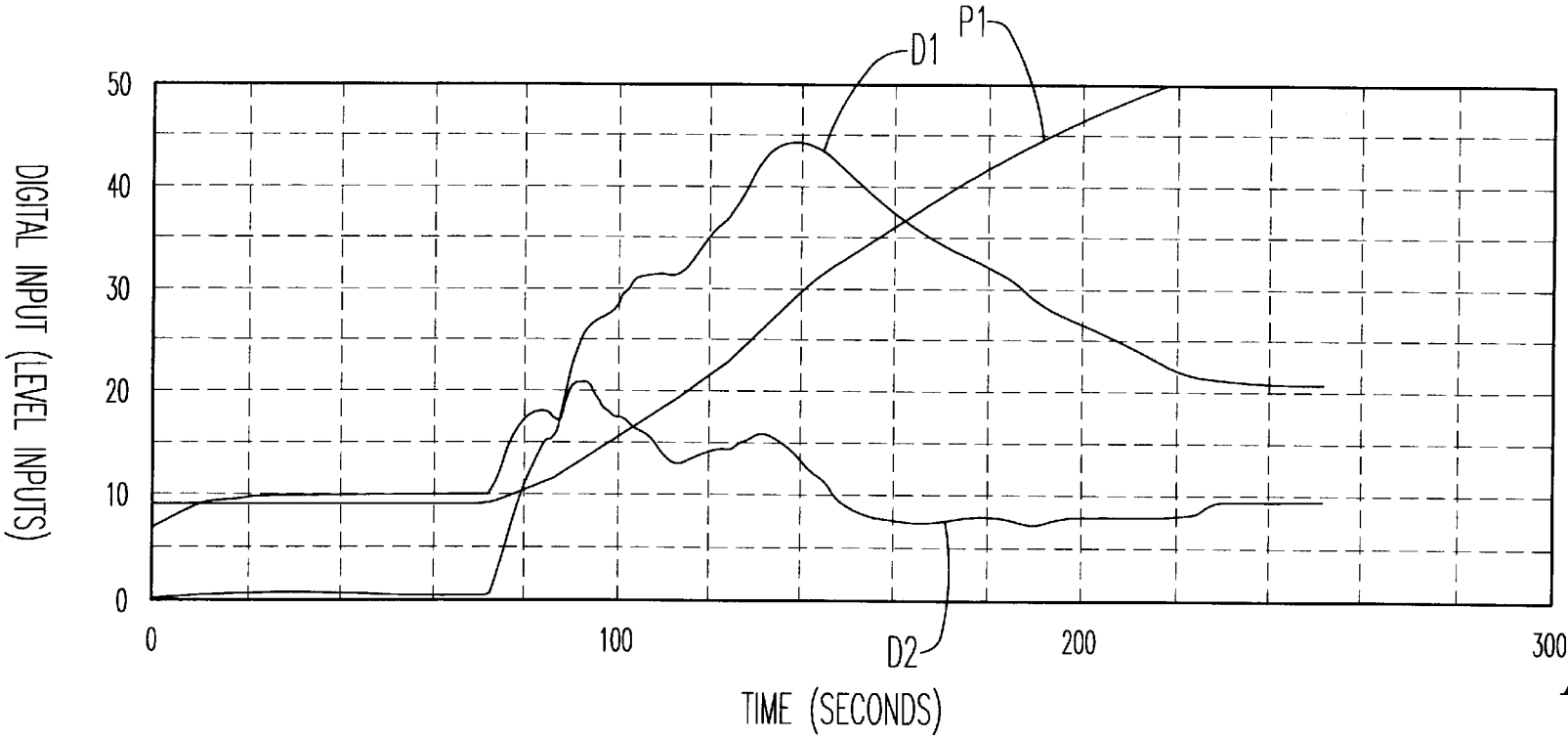
FIGS. 10 and 11 are charts showing various characteristics of two types of fabrics in a wash tub as the wash tub is filled with water.
Figure 11:
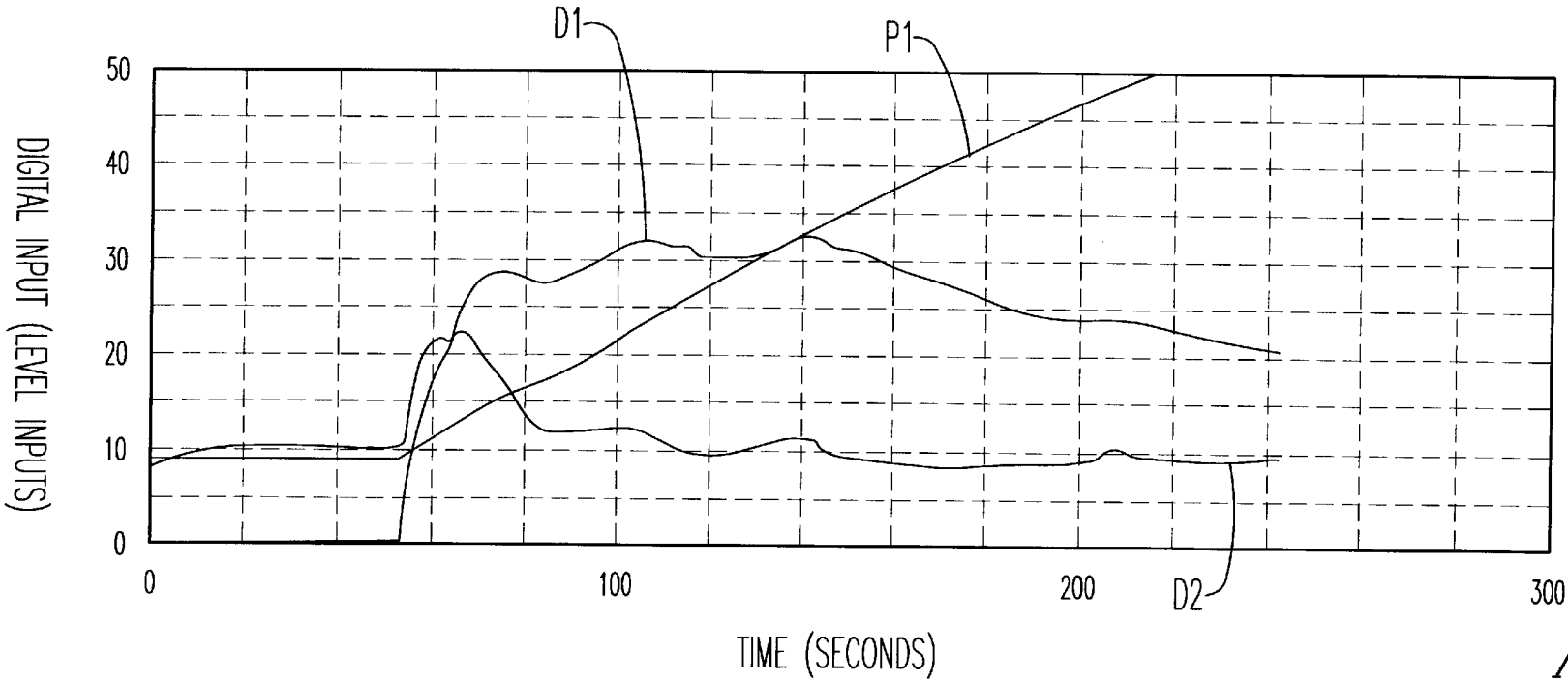

FIGS. 10 and 11 are graphs depicting the signals that result from an eight pound towel load and an eight pound shirt load, respectively. The pressure sensor output is shown as P1 while the first and second derivatives are shown as D1 and D2, respectively. The key features of these graphs can be trained into a data analysis algorithm which determines the fabric content of the load based on these key features. The method by which this is done includes fuzzy logic, neural networks, or any mathematical means to characterize a curve. As can be seen by comparing FIGS. 10 and 11, the first and second derivatives of the fill signal have very different characteristics which is caused by the difference in absorbency and displacement of the fabrics (here, towels versus shirts). For example, as can be seen in FIG. 10, at about 140 seconds, the rate of change (the first derivative D1) in the water level of the eight pound load of towels is at a maximum which is significantly greater than the maximum shown in FIG. 11 which corresponds to a load of shirts. Similarly, the second derivative D2 reaches a different maximum at different time for these two different types of loads. As can be seen, by looking at characteristics such as the magnitude of the first derivative D1, the time when the second derivative D2 reaches a maximum, and the peaks and magnitudes of the second derivative D2, a microprocessor with known information about various fabric types is able to determine the types of fabrics in a wash load. By storing values for known characteristics for various types of fabrics, a microprocessor can compare data from a current load of clothing in a fill cycle with the stored data to determine what type of fabric is currently in the washing machine.

Fuzzy Logic Rules

Rules for XLARGE

If last rate difference is positive then filling is not done; If Ross level is xlarge and peak rate level is xlarge then filling is not done.

Rules for LARGE

If level is medium and Ross level is large and peak rate level is large and last rate difference is zero then filling is done; If level is medium and Ross level is large and peak rate level is large and last rate difference is small negative then filling is done; If level is medium and Ross level is large then filling is done; If level is medium and peak rate level is large then filling is done; If level is medium and Ross level is medium then filling is done; If level is medium and peak rate level is medium then filling is done; If level is medium and Ross level is medium and peak rate level is medium then filling is done; If level is medium and Ross level is small then filling is done; If level is medium and peak rate level is small then filling is done; If level is medium and Ross level is small and peak rate level is small then filling is done.

Rules for MEDIUM

If level is small and Ross level is medium and peak rate level is medium and last rate difference is zero then filling is done; If level is small and Ross level is medium and peak rate level is medium and last rate difference is small negative then filling is done; If level is small and Ross level is medium then filling is done; If level is small and peak rate level is medium then filling is done; If level is small and Ross level is small then filling is done; If level is small and peak rate level is small then filling is done; If level is small and last rate difference is zero then filling is done; If level is small and last rate difference is negative then filling is not done; If level is small and Ross level is large then filling is not done; If level is small and peak rate level is large then filling is not done; If level is small and Ross level is xlarge then filling is not done; If level is small and peak rate level is xlarge then filling is not done.

Rules for SMALL

If level is xsmall and Ross level is small and peak rate level is small and last rate difference is zero then filling is done; If level is xsmall and Ross level is small and peak rate level is small then filling is done; If level is xsmall and Ross level is small and last rate difference is zero then filling is done; If level is xsmall and Ross level is small then filling is done; If level is xsmall and peak rate level is small then filling is done; If level is xsmall and last rate difference is zero then filling is done; If level is xsmall and last rate difference is negative then filling is not done.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A method of automatically filling a clothes washing machine comprising the steps of:

initiating water flow into the washing machine;

sensing the water level in the washing machine over time;

determining a plurality of values indicative of the conditions in the washing machine based on the sensed water level;

determining a proper fill level based on the plurality of values; and stopping the flow of water when the water level reaches the proper fill level.

2. The method of claim 1 wherein a first value of the plurality of values is related to wash load characteristics.

3. The method of claim 2 wherein the first value of the plurality of values is determined by:

observing the time required to fill the washing machine to a first level;

observing the time required to fill the washing machine to a second level, wherein the second level is greater than the first level;

determining an expected time to fill the washing machine to the first level based on the time required to fill the washing machine to the second level; and comparing the expected time and the observed time to fill the washing machine to the first level.

4. The method of claim 3 further comprising the steps of::

taking the second derivative of the sensed water level over time;

determining when the second derivative becomes negative; and determining a second value of the plurality of values based on when the second derivative becomes negative.

5. The method of claim 4 further comprising the steps of:

determining and storing a first rate of change of water level at a first time;

determining a second rate of change of water level at a second time;

determining the difference between the stored first rate of change and the second rate of change; and determining a third value of the plurality of values based on the difference between the stored first rate of change and the second rate of change.

6. The method of claim 5 further comprising the steps of:

dividing the washing machine into a number of water level ranges; and determining a fourth value of the plurality of values by determining which one of the water level ranges the sensed water level falls within.

7. The method of claim 6 further comprising the steps of:

determining characteristics of the fabrics in the washing machine based on the first and second derivatives;

comparing the determined characteristics with known characteristics of various fabric types to determine the types of fabric in the washing machine; and determining a fifth value of the plurality of values based on the comparison of the determined characteristics with known characteristics.

8. The method of claim 1 further comprising the steps of:

dividing the washing machine into a number of water level ranges; and determining one of the plurality of values by determining which one of the water level ranges the sensed water level falls within.

9. The method of claim 1 wherein one of the plurality of values is related to the rate of change of the sensed water level.

10. The method of claim 9 wherein the one of the plurality of values is determined by:

determining and storing a first rate of change of water level at a first time;

determining a second rate of change of water level at a second time; and determining the difference between the stored first rate of change and the second rate of change.

11. The method of claim 10 wherein the first and second rates of change of water level are determined by taking the first derivative of the sensed water level at the first and second times.

12. The method of claim 1 wherein one of the plurality of values is related to a time at which the rate of change of the sensed water level stops increasing.

13. The method of claim 12 wherein the one of the plurality of values is determined by:

taking the second derivative of the sensed water level over time;

determining when the second derivative becomes negative; and determining the one of the plurality of values based on when the second derivative becomes negative.

14. The method of claim 1 wherein the proper fill level is determined by using a fuzzy logic algorithm to combine the plurality of values.

15. The method of claim 14 wherein the plurality of values are each scaled and added together to provide an indication of when the flow of water should be stopped.

16. The method of claim 1 wherein one of the plurality of values is related to the types of fabric in the washing machine.

17. The method of claim 16 wherein the one of the plurality of values is determined by:

taking the first derivative of the sensed water level over time;

taking the second derivative of the sensed water level over time;

determining characteristics of the fabrics in the washing machine based on the first and second derivatives; and comparing the determined characteristics with known characteristics of various fabric types to determine the types of fabric in the washing machine.

18. An apparatus for automatically filling a clothes washing machine comprising:

a water flow valve for controlling the flow of water into the washing machine;

a level sensor for sensing the water level in the washing machine over time;

a microprocessor operatively connected to the water flow valve and the level sensor, the microprocessor performing the processing steps of:

using the sensed water level over time to derive a number of values relating to various conditions in the washing machine;

determining a desired fill level based on the number of values; and controlling the operation of the water flow valve so that the washing machine is filled to the desired fill level.

19. The apparatus of claim 18 wherein the level sensor is comprised of an analog pressure sensor.

20. The apparatus of claim 19 further comprising a pressure sensor circuit electrically connected to the analog pressure sensor and the microprocessor.

21. The apparatus of claim 18 further comprising water valve relay electrically connected to the microprocessor and the water flow valve for controlling the operation of the water flow valve.

22. A method of determining when a load of clothes in a washing machine is covered by or is floating on water during a water fill cycle comprising the steps of:

providing a water level sensor;

sensing the water level in the washing machine;

monitoring the sensed water level over time;

determining the rate of change in the sensed water level over time; and determining when the load of clothes is covered by or is floating on the water by determining when the rate of change of the water level of the washing machine becomes constant.

23. The method of claim 22 further comprising the steps of:

determining the first derivative of the sensed water level in the washing machine;

determining the second derivative of the sensed water level in the washing machine;

determining when the rate of change of the water level of the washing machine becomes constant based on the first and second derivatives.

24. The method of claim 23 further comprising the step of:

determining when the rate of change of the water level of the washing machine becomes constant by observing when the first derivative is not positive.

25. A method of determining the fabric type of clothing in an automatic washing machine comprising the steps of:

monitoring the level of water in the washing machine while filling the washing machine with water over time;

creating a first set of values relating to the water level signal to create a water level signal;

determining the first derivative of the water level signal;

creating a second set of values relating to the first derivative of the water level signal;

determining the second derivative of the water level signal;

creating a third set of values relating to the second derivative of the water level signal; and determining the fabric type of the clothing in the washing machine based on the first, second, and third sets of values.

26. The method of claim 25 further comprising the steps of:

providing first, second, and third sets of values for known fabric types; and determining the fabric type of the clothing in the washing machine based on a comparison of the created first, second, and third sets of values with the known sets of values.

27. The method of claim 25 further comprising the steps of:

providing a microprocessor;

storing data relating to characteristics of known fabric types; and determining the fabric type of the clothing in the washing machine based on a comparison of the created sets of values with the stored data.

28. The method of claim 25 further comprising the steps of:

providing a microprocessor;

storing data relating to certain characteristics of known fabric types; and determining the fabric type of the clothing in the washing machine by recognizing characteristics among the first, second, and third sets of values which correlate to the stored characteristics of known fabric types.

* * * * *